US011002098B2

(12) United States Patent
Andersen

(10) Patent No.: US 11,002,098 B2
(45) Date of Patent: May 11, 2021

(54) DOWNHOLE PATCHING SETTING TOOL

(71) Applicant: Welltec Oilfield Solutions AG, Zug (CH)

(72) Inventor: Tomas Sune Andersen, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 141 days.

(21) Appl. No.: 16/005,919

(22) Filed: Jun. 12, 2018

(65) Prior Publication Data

US 2018/0355691 A1 Dec. 13, 2018

(30) Foreign Application Priority Data

Jun. 13, 2017 (EP) ..... 17175617

(51) Int. Cl.

| | |
|---|---|
| ***E21B 29/10*** | (2006.01) |
| ***E21B 33/124*** | (2006.01) |
| ***E21B 43/10*** | (2006.01) |
| ***E21B 34/10*** | (2006.01) |

(52) U.S. Cl.

CPC ..... *E21B 29/10* (2013.01); *E21B 33/1243* (2013.01); *E21B 34/10* (2013.01); *E21B 43/105* (2013.01); *E21B 43/108* (2013.01)

(58) Field of Classification Search

CPC ..... E21B 43/108

See application file for complete search history.

(56) References Cited

U.S. PATENT DOCUMENTS

| | | | | |
|---|---|---|---|---|
| 2,812,025 | A * | 11/1957 | Doherty | E21B 43/086 166/207 |
| 3,659,648 | A * | 5/1972 | Cobbs | E21B 33/128 166/120 |
| 4,069,573 | A * | 1/1978 | Rogers, Jr. | B21D 22/105 138/98 |
| 2002/0162664 | A1* | 11/2002 | Bode | E21B 43/086 166/380 |
| 2005/0016740 | A1* | 1/2005 | Aldaz | E21B 33/1246 166/387 |
| 2005/0121203 | A1* | 6/2005 | Richard | E21B 43/103 166/380 |

(Continued)

OTHER PUBLICATIONS

Extended Search Report for EP17175617.4 dated Dec. 20, 2017, 9 pages.

*Primary Examiner* — Steven A MacDonald
(74) *Attorney, Agent, or Firm* — Nixon & Vanderhye P.C.

(57) ABSTRACT

A downhole patch setting tool for expanding a patch over a distance of 10+ metres in a well, has a top and a tool body having a bore, an outer face, a first end and a second end, the second end being arranged closer to the top than the first end, the bore at least extending from a first bladder assembly to a second bladder assembly, an expandable metal patch, the first bladder assembly and the second bladder assembly creating an annular space therebetween, the expandable metal patch having an inner diameter in an unexpanded condition, the tool body having a first and second openings, providing fluid communication between the bore and the first bladder assembly and the second bladder assembly to allow pressurised fluid to expand the bladder assemblies, and a valve arrange to control passage of the pressurised fluid from the bore to the annular space.

16 Claims, 6 Drawing Sheets

(56) References Cited

U.S. PATENT DOCUMENTS

Figure 1:
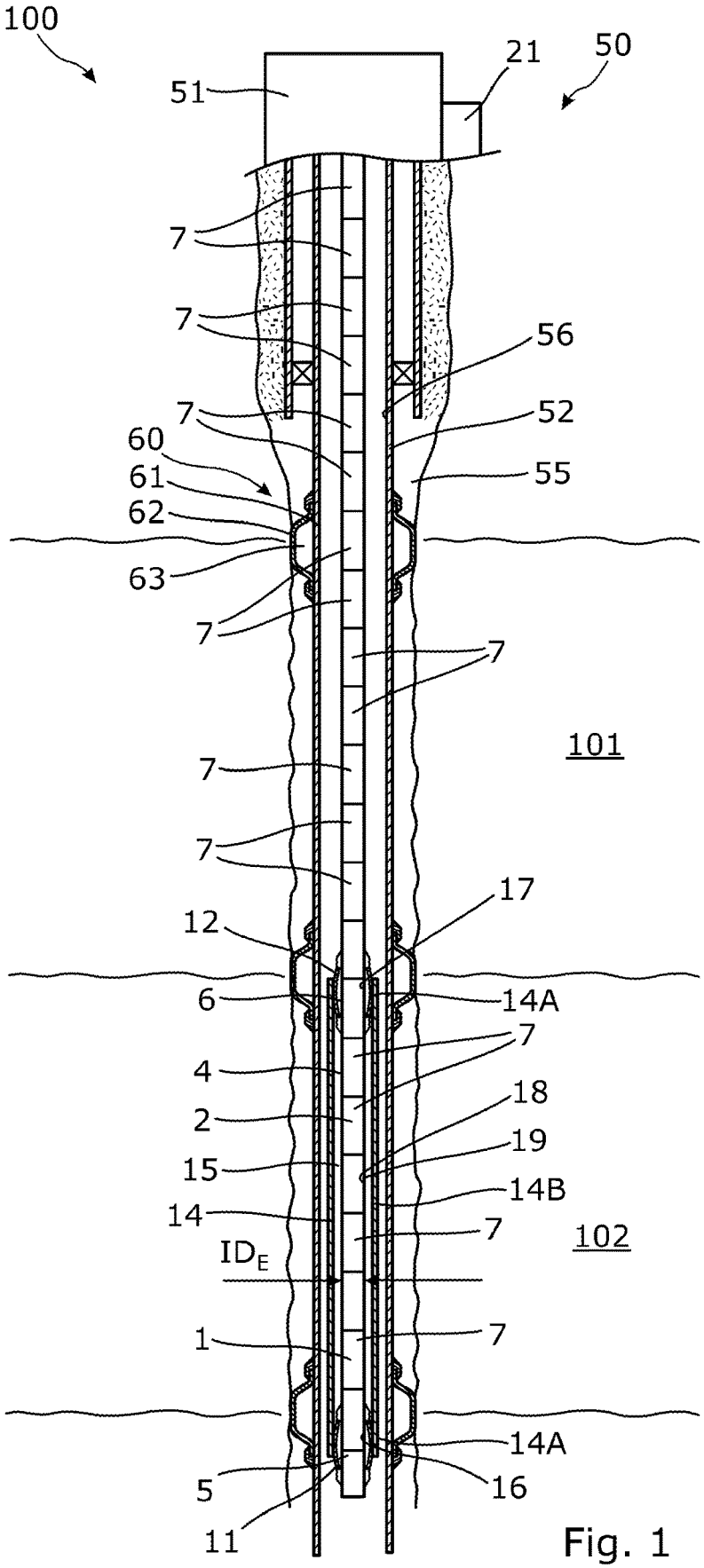

| | | | | |
|---|---|---|---|---|
| 2006/0032628 | A1* | 2/2006 | McGarian | E21B 29/10 166/191 |
| 2006/0124304 | A1* | 6/2006 | Bloess | E21B 33/134 166/285 |
| 2007/0029093 | A1* | 2/2007 | Bosley | E21B 34/08 166/373 |
| 2009/0188569 | A1* | 7/2009 | Saltel | E21B 29/10 137/15.11 |
| 2010/0132952 | A1* | 6/2010 | Nicolas | E21B 43/103 166/369 |
| 2010/0147535 | A1* | 6/2010 | Gorrara | E21B 43/103 166/382 |
| 2013/0220641 | A1* | 8/2013 | Fripp | E21B 33/1208 166/386 |
| 2014/0076581 | A1* | 3/2014 | Gorrara | E21B 43/10 166/380 |
| 2014/0332232 | A1* | 11/2014 | Hallandbæk | E21B 33/1277 166/373 |
| 2015/0275631 | A1* | 10/2015 | Saltel | E21B 29/10 166/386 |
| 2016/0024896 | A1* | 1/2016 | Johnson | E21B 33/1208 166/302 |
| 2016/0053568 | A1* | 2/2016 | Saltel | E21B 34/06 166/179 |
| 2018/0355691 | A1* | 12/2018 | Andersen | E21B 29/10 |

* cited by examiner

DOWNHOLE PATCHING SETTING TOOL

This application claims priority to EP Patent Application No. 17175617.4 filed Jun. 13, 2017, the entire contents of which are hereby incorporated by reference.

The present invention relates to a downhole patch setting tool for expanding a patch over a distance of more than 10 metres in a well. The present invention also relates to a downhole completion system and to a patch setting method.

When having a well that produces too much water, patches are expanded downhole to seal off part of the well tubular metal structure, causing the water production to be reduced. Thus, when a leak, an opening, a valve or a perforation in the well tubular structure is identified a patch is inserted and expanded opposite the water producing part. However, in the event that the water producing part of the well tubular structure is a perforated zone extending over a distance of 10 metres, no patches and no patch setting system that are long enough exist, and several patches have to be set in succession of each other. However, setting several patches in succession of each other takes a long time as several runs in the well are required, and the patches are seldom able to seal off all the perforations properly.

It is an object of the present invention to wholly or partly overcome the above disadvantages and drawbacks of the prior art. More specifically, it is an object to provide an improved downhole patch setting tool capable of properly patching a zone which is longer than 12 metres.

The above objects, together with numerous other objects, advantages and features, which will become evident from the below description, are accomplished by a solution in accordance with the present invention by a downhole patch setting tool for expanding a patch over a distance of more than 10 metres in a well, the downhole patch setting tool having a top and comprising:

a tool body having a bore, an outer face, a first end and a second end, the second end being arranged closer to the top than the first end, a first bladder assembly arranged at the first end on the outer face and a second bladder assembly arranged at the second end on the outer face, the bore at least extending from the first bladder assembly to the second bladder assembly, and an expandable metal patch circumferenting the tool body, the first bladder assembly and the second bladder assembly creating an annular space therebetween, the expandable metal patch having an inner diameter in an unexpanded condition, the tool body having a first opening opposite the first bladder assembly and a second opening opposite the second bladder assembly, providing fluid communication between the bore and the first bladder assembly and the second bladder assembly in order to allow pressurised fluid into the bladder assemblies to expand the bladder assemblies, wherein the tool body has a third opening arranged between the first bladder assembly and the second bladder assembly, and a valve arranged in the third opening for controlling passage of the pressurised fluid from the bore to the annular space.

The valve may be a pressure controlled valve or a pressure relief valve.

In addition, the valve may be a pressure activated valve.

Also, the patch may have a length of more than 10 metres.

Moreover, the valve may have a first position in which fluid is not allowed to pass into the annular space and a second position in which fluid is allowed to pass into the annular space.

In addition, the valve may be pressure activated to open for allowing fluid to enter the annular space.

Furthermore, the valve may open at a certain pressure.

The valve may move from the first position to the second position at a certain pressure.

Moreover, a pump may be fluidly connected to the bore.

Also, the pump may be driven by a motor in the tool.

Further, the pump may be arranged in the tool or at surface/top of the well.

In addition, the first bladder assembly and the second bladder assembly may be arranged having a mutual distance of at least 15 metres, preferably at least 25 metres, and more preferably at least 50 metres.

Furthermore, the expandable metal patch may be one tubular pipe.

The expandable metal patch may be a continuous tubular metal pipe.

Moreover, the tool body may be mounted from drill pipes.

Also, the tool body may have a plurality of drill pipes between the first bladder assembly and the second bladder assembly.

Furthermore, the second end of the tool body may be connected with the drill pipe for supplying pressurised fluid to the bore.

Additionally, the second end of the tool body may be connected to a wireline.

Further, the second end of the tool body may be connected to the pump which is driven by a motor, which is connected to a wireline.

The first opening may have a valve.

Also, the second opening may have a valve.

Moreover, the expandable metal patch may be fastened to the tool body by the first bladder assembly and the second bladder assembly being expanded to abut the inner diameter of the expandable metal patch in the unexpanded condition.

The downhole patch setting tool according to the present invention may further comprise a locking element for locking the expandable metal patch in the unexpanded condition along a longitudinal extension of the tool body.

Said downhole patch setting tool according to the present invention may further comprise a third bladder assembly arranged on the outer face in between the first bladder assembly and the second bladder assembly, and a fourth opening in the tool body opposite the third bladder assembly for providing fluid communication between the bore and the fourth bladder assembly, and the tool may comprise a second third opening, and the two third openings may be arranged on either side of the third bladder assembly so one of the third openings is arranged between the first bladder assembly and the second bladder assembly and the other of the third openings is arranged between the third bladder assembly and the second bladder assembly.

Further, the first end of the tool body may be closed or closable by dropping a ball into the bore or a check valve, allowing fluid from the well to enter the bore but preventing fluid in the bore from exiting through the check valve.

By having a check valve in the closed end, the bore can be pressurised to expand the bladder assemblies while being easy to deploy as the fluid in the well can enter the bore.

Furthermore, the bladder assembly may have a bladder and bladder connections, where the bladder is made of an elastomeric material.

In addition, the bladder connections may be made of metal.

Said bladder connections may be screwed onto the outer face.

Moreover, the bladder connections may comprise reinforcement elements configured to reinforce the bladder during expansion.

Also, the expandable metal patch may comprise sealing elements on an outer patch face.

The downhole patch setting tool may comprise a second expandable metal patch.

The present invention also relates to a downhole completion system, comprising:

a well tubular metal structure arranged in a borehole, and an expandable metal patch set by a downhole patch setting tool according to the present invention, the expandable metal patch abutting and being fastened by means of friction to an inner face of the well tubular metal structure.

Further, the present invention relates to a patch setting method for expanding a very long patch sealing for sealing off a zone of more than 12 metres, comprising:

arranging a downhole patch setting tool according to the present invention in a borehole or in a well tubular metal structure in the borehole of a well, pressurising the bore, letting the pressurised fluid into the first bladder assembly and into the second bladder assembly to expand the first bladder assembly and the second bladder assembly in order to expand the expandable metal patch opposite the first bladder assembly and the second bladder assembly, opening the valve in the third opening by means of fluid, letting pressurised fluid into the annular space in order to expand the expandable metal patch between the first bladder assembly and the second bladder assembly, and decreasing the pressure inside the bore, deflating the first bladder assembly and the second bladder assembly.

The present invention also relates to a patch setting method according to the present invention, wherein the valve in the third opening is opened when the pressurised fluid reaches a pre-determined pressure.

Finally, said method may comprise pressurising the bladder assemblies simultaneously or sequentially.

Figure 2:
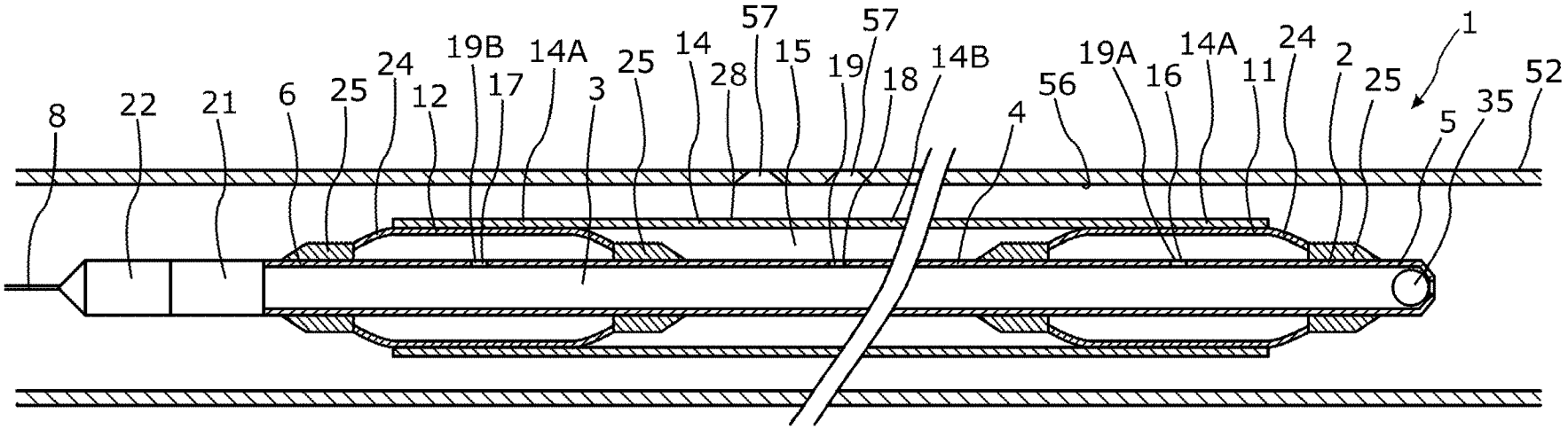
Figure 3A:
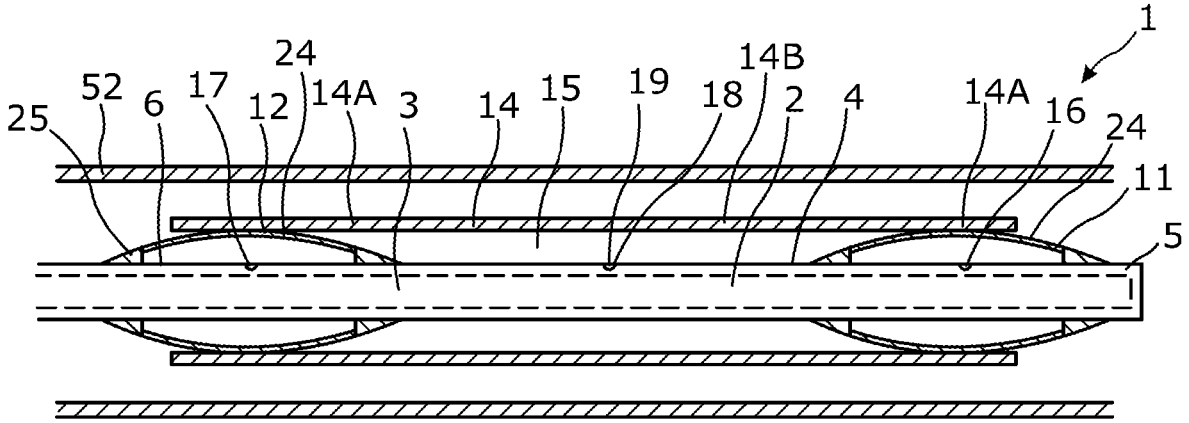
Figure 3B:
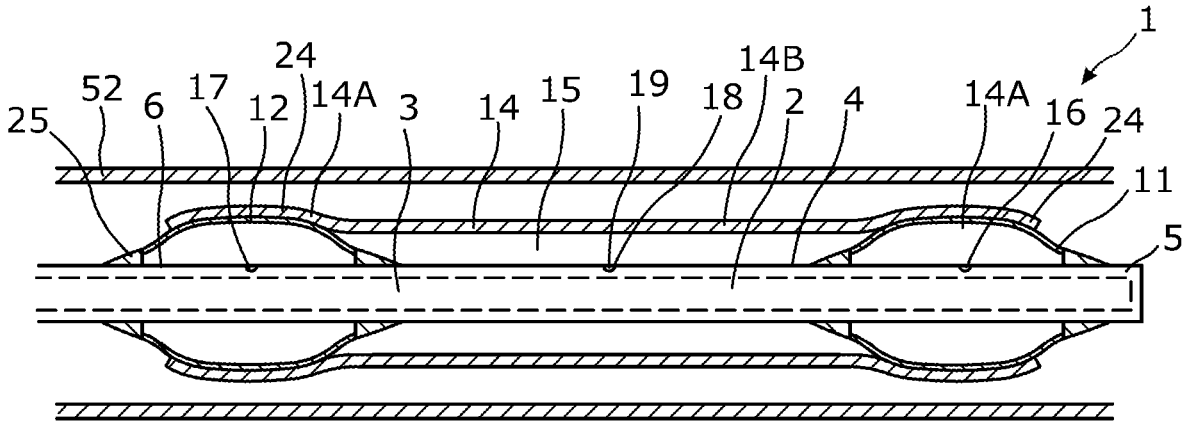
Figure 3C:
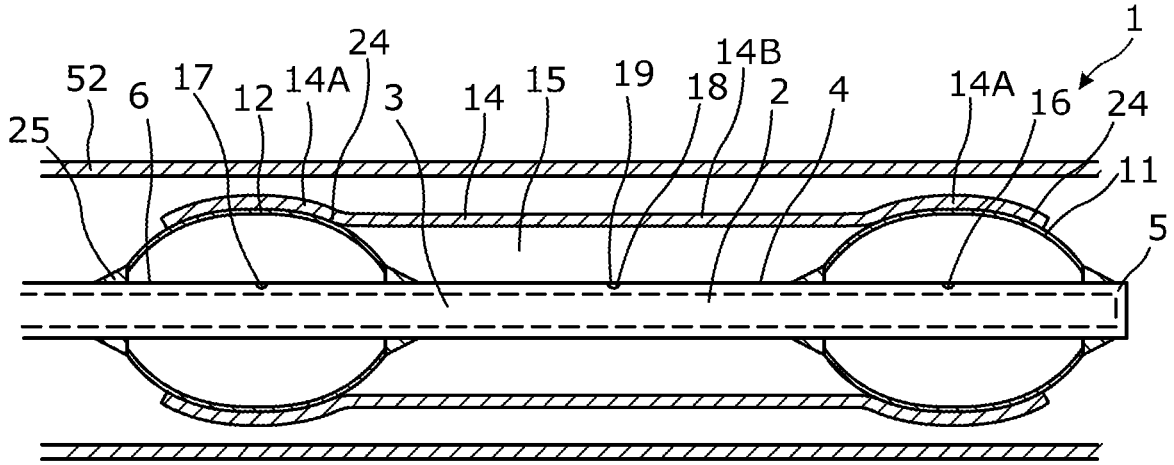
Figure 3D:
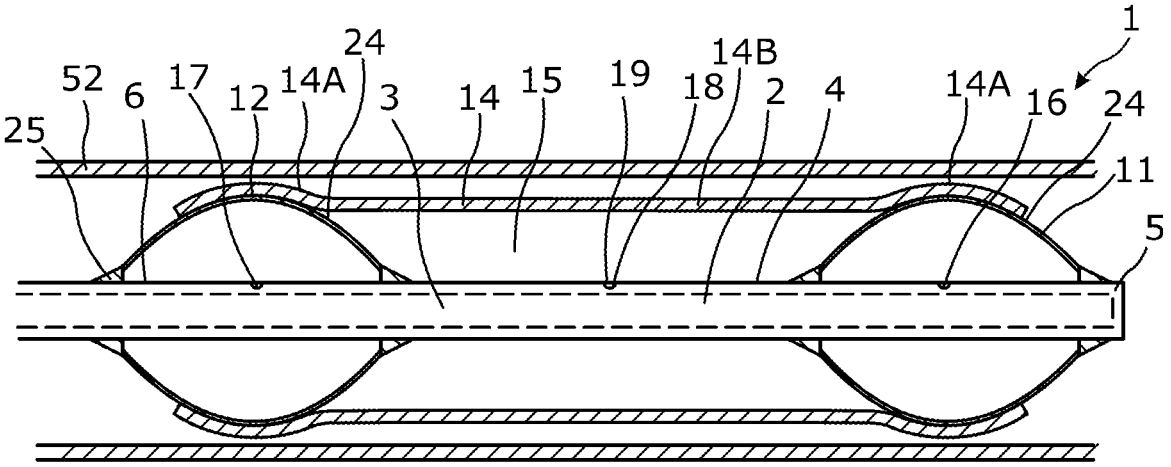
Figure 3E:
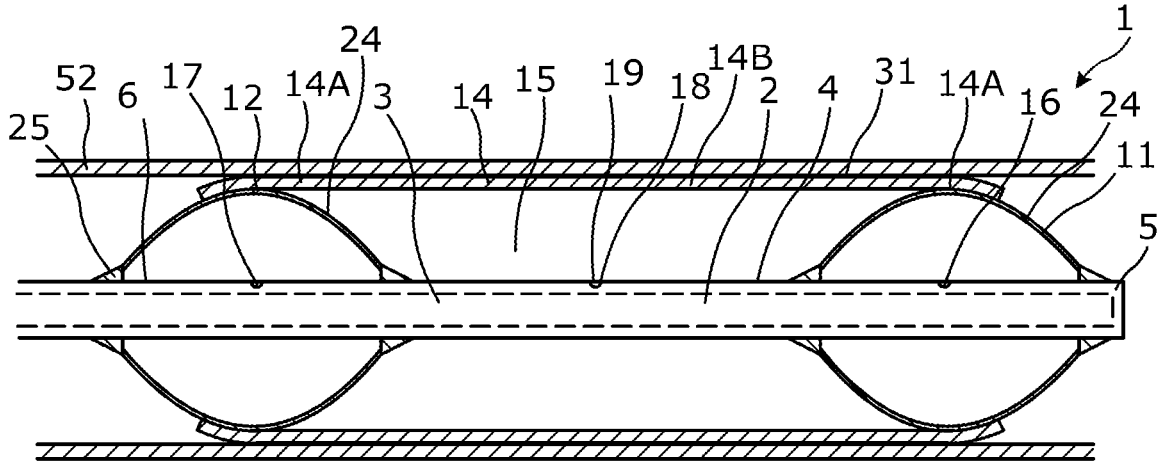
Figure 4:
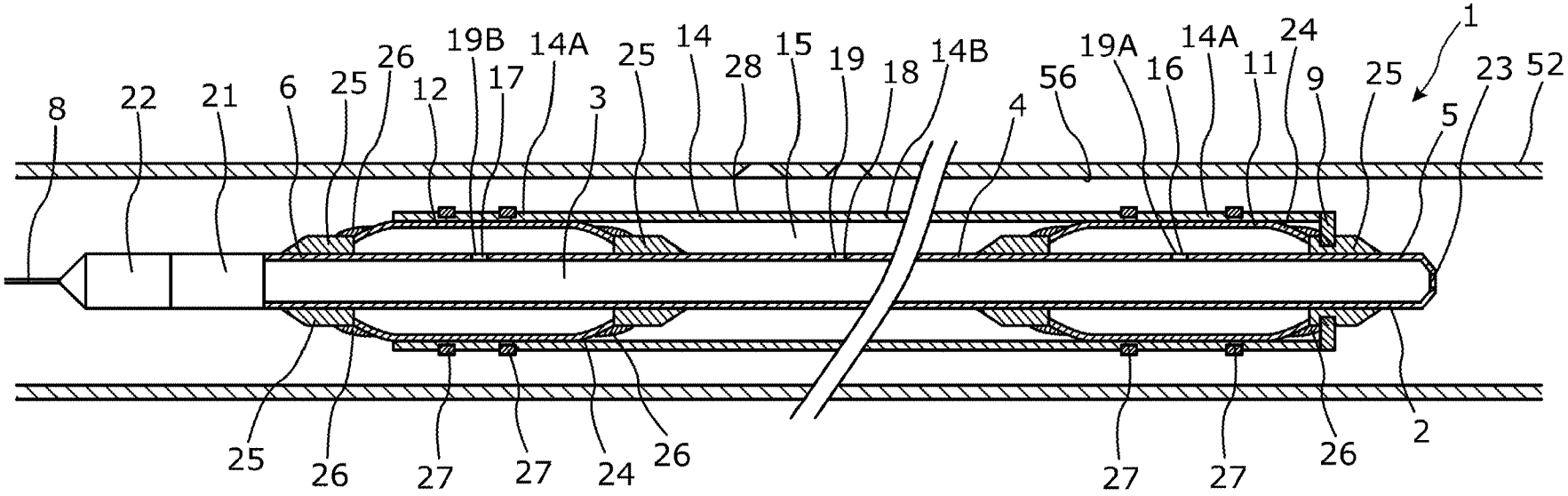
Figure 5:
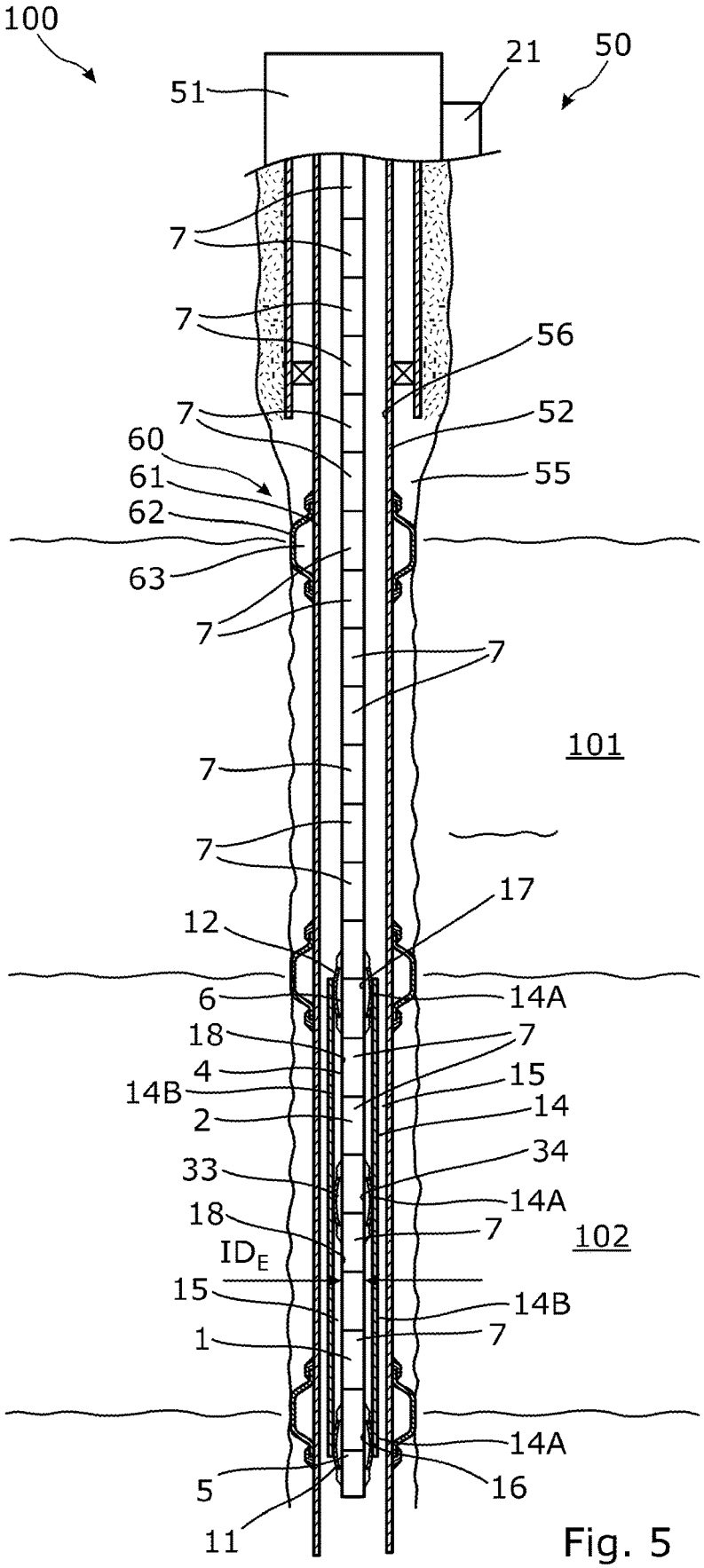

The invention and its many advantages will be described in more detail below with reference to the accompanying schematic drawings, which for the purpose of illustration show some non-limiting embodiments and in which:

FIG. 1 shows a partial cross-sectional view of a downhole patch setting system having a patch setting tool in a well tubular metal structure, FIG. 2 shows a partly cross-sectional view of another downhole patch setting tool and an expandable metal patch in its initial and unexpanded condition, FIG. 3A shows a partly cross-sectional view of yet another downhole patch setting tool having an unexpanded expandable metal patch, FIG. 3B shows a partly cross-sectional view of the downhole patch setting tool of FIG. 3A in which the expandable metal patch is partly expanded and partly unexpanded, FIG. 3C shows a partly cross-sectional view of the downhole patch setting tool of FIG. 3A in which both the two ends and the middle section of the expandable metal patch are slightly expanded, FIG. 3D shows a partly cross-sectional view of the downhole patch setting tool of FIG. 3C in which both the two ends and the middle section of the expandable metal patch are expanded more than in FIG. 3C and almost abut the wall of the well tubular metal structure while fluid can still pass the ends, FIG. 3E shows a partly cross-sectional view of the downhole patch setting tool of FIG. 3A in which the expandable metal patch is fully expanded, FIG. 4 shows a partly cross-sectional view of another downhole patch setting tool, and FIG. 5 shows a partly cross-sectional view of yet another downhole patch setting tool having a third bladder assembly.

All the figures are highly schematic and not necessarily to scale, and they show only those parts which are necessary in order to elucidate the invention, other parts being omitted or merely suggested.

FIG. 1 shows a downhole patch setting tool 1 for expanding an expandable metal patch 14 over a distance of more than 50 metres in a well 50 in order that a whole production zone 101, 102 can be isolated, e.g. if the production zone produces too much water, or if the openings in the well tubular metal structure are worn so they have become too large, or if the well tubular metal structure 52 has leaks 57, shown in FIG. 2. The downhole patch setting tool 1 comprises a tool body 2 having a bore 3 (shown in FIG. 2), an outer face 4, a first end 5 and a second end 6. The second end is arranged closer to a top 51 of the well than to the first end. The downhole patch setting tool 1 further comprises a first bladder assembly 11 arranged at the first end on the outer face and a second bladder assembly 12 arranged at the second end on the outer face, the bore extends at least from the first bladder assembly to the second bladder assembly. The expandable metal patch 14 circumferents the tool body 2, the first bladder assembly and second bladder assembly, thereby creating an annular space 15 therebetween. The expandable metal patch 14 has an inner diameter IDE in an unexpanded condition shown in FIG. 1. The tool body 2 furthermore has a first opening 16 opposite the first bladder assembly 11 and a second opening 17 opposite the second bladder assembly 12, providing fluid communication between the bore and the first and the second bladder assemblies in order to allow pressurised fluid into the bladder assemblies to expand the bladder assemblies. The tool body 2 has a third opening 18 arranged between the first bladder assembly and the second bladder assembly, and a valve 19 arranged in the third opening for controlling passage of the pressurised fluid from the bore to the annular space.

By having the third opening and the valve arranged therein, the downhole patch setting tool is able to pressurise first the parts 14A of the expandable metal patch opposite the first bladder assembly and the second bladder assembly and immediately thereafter, the rest 14B of the expandable metal patch arranged between the first bladder assembly and the second bladder assembly, so that the patch is expanded in the pressurising step. The valve provides a small restriction and the bladders are thus expanded slightly before the fluid enters the space. However, the valve only provides a small difference so that the middle part 14B of the expandable metal patch is expanded slightly less radially than the end parts 14A of the expandable metal patch. In this way, the whole expandable metal patch is expanded in one pressurising step and the middle part 14B is expanded slightly less radially than the end parts resulting in only a small gap between the wall which the end parts 14A of the expandable metal patch abut. Due to the fact that the middle part is expanded simultaneously with the end parts, the fluid in an outer space 31 (shown in FIG. 3E) between the middle part of the expandable metal patch and the wall of the well tubular metal structure is pressed outwards by means of the middle part of the expandable metal patch when expanding. The fluid then passes the end parts and a lot of the fluid is thus not trapped in the outer space 31 between the expanded end parts. The inner diameter of the well tubular structure is only diminished by the thickness of the expandable metal patch and an additional approximately 0.5 mm depending on the thickness and the material of the expandable metal patch. Furthermore, the expandable metal patch may be very long and much longer than the known patches, since the annular space is expanded by a pressurised fluid and can be as long as required. Thus, the length of the expandable metal patch depends on the length of the tubular body.

The valve 19 arranged in the third opening 18 is a pressure controlled valve or a pressure relief valve, as shown in FIG. 3A, so that when the first and the second bladder assemblies 11, 12 have been slightly expanded as shown in FIG. 3B, then fluid is let into the annular space and the middle part of the expandable metal patch begins to expand, as shown in FIG. 3C. This simultaneous expansion of the end parts and the middle part of the expandable metal patch is continued, as shown in FIG. 3D, until end parts 14A of the expandable metal patch 14 abut the well tubular metal structure 52, as shown in FIG. 3E. When the first bladder assembly 11 and the second bladder assembly 12 have been slightly expanded the pressure inside the bore 3 increases and the valve opens. The outer space 31, shown in FIG. 3E, is very small due to this simultaneous expansion and only a small amount of well fluid surrounding the expandable metal patch is trapped in this outer space. Thus, when the pressure reaches a predetermined pressure, the valve 19 opens so that the pressurised fluid enters the annular space 15 and the rest and the middle part 14B of the expandable metal patch 14 is expanded, as shown in FIG. 3C, and in this way the whole expandable metal patch is expanded. Thus, the first bladder assembly and the second bladder assembly are arranged having a mutual distance of at least 15 metres, preferably at least 25 metres, and more preferably at least 50 metres. The expandable metal patch 14 is one tubular pipe and is a continuous tubular metal pipe. The first end of the tool body is closed.

By having a pressure controlled valve, the valve is activated by a certain pressure and no tool or ball is required to open the valve. Thus, the expansion of the expandable metal patch can be made in one pressurisation step so that any deformation hardening is avoided. When having several pressurisation steps, the expandable metal patch will harden during the time between the pressurisation steps and thus after such hardening, the patch will require a higher pressure to start expanding again.

In order to expand the first bladder assembly 11 and the second bladder assembly 12, a certain force is required and additional force is required to also expand the expandable metal patch. Therefore, before the end parts of the expandable metal patch begin to expand, the pressure increases to a level above the pressure required to expand the end parts alone. The valve is dimensioned to open when the pressure reaches the pressure needed for expanding both the bladder assemblies and the end parts in order that expansion of the middle part starts almost simultaneously and immediately after the beginning of the expansion of the end parts.

In FIG. 1, the downhole patch setting tool has a tool body mounted from drill pipes 7 and the tool body has a plurality of drill pipes 7 between the first bladder assembly 11 and the second bladder assembly 12. Thus, the drill pipes form a spacer between the first and the second bladder assemblies 11, 12 and the distance between the first and the second bladder assemblies can vary dependent on the length of the expandable metal patch 14 required for patching the leak, perforations or similar opening(s) to be sealed off. The second end 6 of the downhole patch setting tool 1 is connected to a string of drill pipes 7 so that the bore of the downhole patch setting tool 1 is pressurised by pressurising the drill pipes mounted into one string. A pump 21 is arranged at the top 51 of the well 50 and is fluidly connected to the bore.

In FIG. 2, the pump 21 is arranged downhole in the downhole patch setting tool and is driven by a motor 22 also in the tool. The second end 6 of the tool body 2 is connected to a wireline 8 for supplying power to the motor. As can be seen, the first opening 16 has a valve 19A and the second opening has a valve 19B for allowing pressurised fluid to enter into the bladder assemblies but preventing the fluid from re-entering the bore 3. During deployment of the tool, the expandable metal patch 14 is fastened to the tool body by the first and the second bladder assemblies being expanded to abut the inner diameter of the expandable metal patch in the unexpanded condition, as shown in FIG. 2. Each bladder assembly 11, 12 has a bladder 24 and bladder connections 25 connecting the bladder to the outer face of the tool body. The bladder connections may be made of metal and screwed onto the outer face of the tool body in order to fasten the bladder 24. The bladder is preferably made of an elastomeric material.

In FIG. 4, the downhole patch setting tool 1 comprises a locking element 9 for locking the expandable metal patch in the unexpanded condition along a longitudinal extension of the tool body during deployment of the tool in the well. As the expandable metal patch is expanded, the inner diameter of the expandable metal patch increases and the patch is released from the locking element 9. The locking element may be a snap ring or a similar closing ring arranged in a groove in the outer face 4 of the tool body 2.

The first end 5 of the tool body 2 is closed in FIGS. 3A-E and in FIG. 2, the first end 5 of the tool body 2 is closable by dropping a ball 35 into the bore. In FIG. 4, a check valve 23 is shown allowing fluid from the well to enter the bore but preventing fluid in the bore from exiting through the check valve. By having a check valve in the closed end 5, the bore 3 can be pressurised to expand the bladder assemblies 11, 12, while the tool is easy to deploy as the fluid in the well can enter the bore. The pressure in the borehole increases as the tool moves downwards, and thus the pressure in the bore is equalised through the check valve as the tool moves downwards.

In order to strengthen the bladder during expansion, the bladder connections 25 comprise reinforcement elements 26, as shown in FIG. 4. The reinforcement elements are configured to reinforce the bladder during expansion so that the bladder does not bulge intentionally outwards. The expandable metal patch 14 comprises sealing elements 27 on an outer patch face 28. By having sealing elements, the patch provides a better seal to the well tubular metal structure 52.

In FIG. 5, the downhole patch setting tool 1 further comprises a third bladder assembly 33 arranged on the outer face in-between the first bladder assembly 11 and the second bladder assembly 12, and a fourth opening 34 in the tool body opposite the third bladder assembly 33 for providing fluid communication between the bore and the fourth bladder assembly. The downhole patch setting tool 1 comprises a second third opening 18 and the two third openings 18 are arranged on either side of the third bladder assembly 33 so one of the third openings is arranged between the first bladder assembly 11 and the third bladder assembly 33, and the other of the third openings 18 is arranged between the third bladder assembly 33 and the second bladder assembly 12.

The invention also relates to a downhole completion system 100 as shown in FIG. 1, where the system comprises a well tubular metal structure 52 arranged in a borehole 55 and an expandable metal patch 14 set by one of the downhole patch setting tools 1 mentioned above. The expandable metal patch 14 is abutting and is fastened by means of friction to an inner face 56 of the well tubular metal structure 52 when the bladder assemblies have been expanded and the annular space 15 therebetween has been pressurised.

Thus, the expandable metal patch is set by the following patch setting method comprising the steps of arranging the downhole patch setting tool in the borehole 55 or in the well tubular metal structure 52 in the borehole 55 of a well 50, pressurising the bore 3 and letting the pressurised fluid into the first and the second bladder assemblies 11, 12 to expand the bladder 24 of the first and the second bladder assemblies for expanding parts 14A of the expandable metal patch 14 opposite the first and the second bladder assemblies. Immediately after the bladder assemblies have started to expand, the valve in the third opening is opened, letting pressurised fluid into the annular space 15 expanding the expandable metal patch between the first and the second bladder assemblies and subsequently, the pressure inside the bore is decreased, deflating the first and the second bladder assemblies. The valve 19 in the third opening is opened when the pressurised fluid reaches a pre-determined pressure. The bladder assemblies may be expanded simultaneously or sequentially.

A stroking tool may be used as the pump and thus as part of the patch setting tool. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

As shown in FIG. 1, the well tubular metal structure may comprise annular barriers 60 for providing zonal isolation. By an annular barrier is meant an annular barrier 60 comprising a tubular metal part 61 mounted as part of the well tubular metal structure and an expandable metal sleeve 62 surrounding and connected to the tubular part defining an annular barrier space 63.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole patch setting tool for expanding a patch over a distance of more than 10 metres in a well, the downhole patch setting tool having a top and comprising:

a tool body having a bore, an outer face, a first end and a second end, the second end being arranged closer to the top than the first end, a first bladder assembly arranged at the first end on the outer face and a second bladder assembly arranged at the second end on the outer face, the bore at least extending from the first bladder assembly to the second bladder assembly, and an expandable metal patch circumferenting the tool body, the first bladder assembly and the second bladder assembly creating an annular space therebetween, the expandable metal patch having an inner diameter in an unexpanded condition, the tool body having a first opening opposite the first bladder assembly and a second opening opposite the second bladder assembly, providing fluid communication between the bore and the first bladder assembly and the second bladder assembly in order to allow pressurised fluid at a predefined pressure into the bladder assemblies to expand the bladder assemblies and end parts of the expandable metal patch, wherein the tool body has a third opening arranged between the first bladder assembly and the second bladder assembly, and a valve arranged in the third opening for controlling passage of the pressurised fluid from the bore to the annular space, wherein the valve is a pressure controlled valve or a pressure relief valve, and wherein the valve is configured to open at the predefined pressure of the pressurized fluid such that a single pressurization step at the predefined pressure causes the middle part of the expandable metal patch to expand substantially simultaneously with the end parts.

2. A downhole patch setting tool according to claim 1, wherein a pump is fluidly connected to the bore.

3. A downhole patch setting tool according to claim 1, wherein the tool body is mounted from drill pipes.

4. A downhole patch setting tool according to claim 3, wherein the tool body has a plurality of drill pipes between the first bladder assembly and the second bladder assembly.

5. A downhole patch setting tool according to claim 1, wherein the expandable metal patch is fastened to the tool body by the first bladder assembly and the second bladder assembly being expanded to abut the inner diameter of the expandable metal patch in the unexpanded condition.

6. A downhole patch setting tool according to claim 1, further comprising a locking element for locking the expandable metal patch in the unexpanded condition along a longitudinal extension of the tool body.

7. A downhole patch setting tool according to claim 1, further comprising a third bladder assembly arranged on the outer face in-between the first bladder assembly and the second bladder assembly, and a fourth opening in the tool body opposite the third bladder assembly for providing fluid communication between the bore and the fourth bladder assembly, and wherein the tool comprises a second third opening and the two third openings are arranged on either side of the third bladder assembly so one of the third openings is arranged between the first bladder assembly and the second bladder assembly and the other of the third openings is arranged between the third bladder assembly and the second bladder assembly.

8. A downhole patch setting tool according to claim 1, wherein the first end of the tool body is closed or closable by dropping a ball into the bore or a check valve, allowing fluid from the well to enter the bore but preventing fluid in the bore from exiting through the check valve.

9. A downhole patch setting tool according to claim 1, wherein the bladder assembly has a bladder and bladder connections, where the bladder is made of an elastomeric material.

10. A downhole patch setting tool according to claim 1, wherein the bladder connections comprise reinforcement elements configured to reinforce the bladder during expansion.

11. A downhole patch setting tool according to claim 1, wherein the expandable metal patch comprises sealing elements on an outer patch face.

12. A downhole patch setting tool according to claim 1, further comprising the pressure relief valve, wherein the pressure relief valve is movable between first and second positions.

13. A downhole patch setting tool according to claim 1, further comprising the pressure controlled valve.

14. A downhole completion system, comprising:

a well tubular metal structure arranged in a borehole, and an expandable metal patch set by a downhole patch setting tool according to claim 1, the expandable metal patch abutting and being fastened by means of friction to an inner face of the well tubular metal structure.

15. A patch setting method for expanding a very long patch sealing for sealing off a zone of more than 12 metres, comprising:

arranging a downhole patch setting tool according to claim 1 in a borehole or in a well tubular metal structure in the borehole of a well, pressurising the bore, letting the pressurised fluid into the first bladder assembly and into the second bladder assembly to expand the first bladder assembly and the second bladder assembly in order to expand the expandable metal patch opposite the first bladder assembly and the second bladder assembly, opening the valve in the third opening by means of fluid, letting pressurised fluid into the annular space in order to expand the expandable metal patch between the first bladder assembly and the second bladder assembly, and decreasing the pressure inside the bore, deflating the first bladder assembly and the second bladder assembly.

16. A patch setting method according to claim 15, wherein the valve in the third opening is opened when the pressurised fluid reaches a pre-determined pressure.

* * * * *